United States Patent [19]

Bidston et al.

[11] 4,127,552

[45] Nov. 28, 1978

[54] ANTISTATIC FOOTWEAR

[75] Inventors: William T. Bidston; Paul A. Blackie, both of Liverpool, England

[73] Assignee: Dunlop Limited, London, England

[21] Appl. No.: 734,864

[22] Filed: Oct. 22, 1976

[30] Foreign Application Priority Data

Oct. 29, 1975 [GB] United Kingdom ..... 44540/75

[51] Int. Cl.[2] ..... C08K 5/12

[52] U.S. Cl. ..... 260/31.8 R; 260/45.7 S; 260/45.85 S; 260/45.85 H; 260/DIG. 15

[58] Field of Search ..... 260/45.7 S, 45.85 S, 260/45.85 H, 31.4, 31.8 R, 31.6, DIG. 15–20

[56] References Cited

U.S. PATENT DOCUMENTS

| | | | |
|---|---|---|---|
| 2,978,440 | 4/1961 | Frissell | 260/DIG. 16 |
| 3,158,585 | 11/1964 | Kelso | 260/31.4 R |
| 3,165,490 | 1/1965 | Uno | 260/DIG. 19 |
| 3,518,224 | 6/1970 | Eggensperger | 260/31.8 R |

FOREIGN PATENT DOCUMENTS

| | | |
|---|---|---|
| 1,175,903 | 1/1970 | United Kingdom. |
| 1,228,324 | 4/1971 | United Kingdom. |

*Primary Examiner*—Paul R. Michl

*Attorney, Agent, or Firm*—Stevens, Davis, Miller & Mosher

[57] ABSTRACT

Antistatic footwear has an outsole of a vinyl chloride polymer composition containing a non-metalic stabilizer for the polymer and both an ionic and a non-ionic antistatic agent. Non-staining, colored, e.g. white outsoles can be produced having satisfactory and stable electrical properties.

17 Claims, No Drawings

ANTISTATIC FOOTWEAR

This invention relates to antistatic footwear.

Rubber-soled boots and shoes have previously been made to meet the electrical properties required of British Standard 2506 by incorporating a predetermined amount of electrically-conducting carbon black in a rubber composition. The carbon black is thoroughly dispersed throughout the rubber composition and is believed to produce conducting 'chains' of molecules. By virtue of these chains the necessary electrically-conducting properties can be achieved and the British Standard specification met. However, there are a number of disadvantages to this technique. Firstly, the use of carbon black presents an obvious and disadvantageous limitation on the colour of the composition and hence the attractiveness of the product. Secondly, it has been found difficult to consistently meet the British Standard specification by this means. This could be due to a number of factors including insufficiently homogeneous dispersion or contamination with other carbon blacks. Thirdly, it has been found that the resistance, and hence the antistatic properties, of the composition can vary with the state of cure of the rubber composition. Fourthly, it has been found that continual flexing of a shoe during use can cause its electrical resistance to increase. One reason for this could be the disorientation of the carbon to carbon 'chains'. Now it is necessary for the soles of antistatic footwear to have a resistance between $5 \times 10^4$ and $5 \times 10^7$ ohms if they are to meet the British Standard Specification (BS 2050 - 1961). Thus it will be appreciated that increasing resistance during use of the product is undesirable. It has proved necessary to regularly test the resistance of rubber-soled footwear and to discard the footwear once its resistance had reached $5 \times 10^7$ ohms.

Plastics-soled antistatic footwear has also been proposed but has also hitherto proved to have a number of disadvantages. Vinyl chloride polymer compositions are normally employed for plastics-soled footwear. Many proprietary types of antistatic agents are available from which to make pvc compositions which meet less stringent electrical resistance specifications e.g. in floor tiles and belting. However, footwear compositions are required to be much softer than tile or belting compositions and also have to meet more severe electrical resistance specifications. The main disadvantage of conventional antistatic agents and formulations in the relatively soft footwear compositions is that they exude in significant amounts. This results in a spoiled product. Some conventionally-used antistatic agents also descrease the effectiveness of the metal stabilisers usually used in pvc formulations. These antistatic agents and metal stabilisers can react together causing quite severe staining. Thus at the high injection temperatures used in footwear manufacture, conventional compositions can be very unstable. Also at these high temperatures, and with the high loadings of stabiliser that are often required, stabiliser exudation can occur.

The present invention provides footwear containing an antistatic vinyl chloride polymer composition to meet the required British Standard Specifications and which overcomes many of the disadvantages outlined above for previously-suggested antistatic footwear.

Accordingly, the invention provides antistatic footwear at least the out sole of which is formed from a composition comprising a vinyl chloride polymer, a nonionic antistatic agent, an ionic antistatic agent and a non-metallic stabiliser for the vinyl chloride polymer, the sole having a Shore A Hardness in the range 40 to 65. The vinyl chloride polymer is preferably poly(vinyl chloride) - (pvc) - but copolymers, e.g. vinyl chloride-vinyl acetate copolymers, may be used particularly in a minor proportion with a major proportion of pvc.

The vinyl chloride polymer may be blended with a minor proportion of another compatible polymer. For example, a nitrile rubber or polyvinyl acetate may be used. The nitrile rubber should preferably be a medium nitrile, e.g. about 32% acrylonitrile content, of low Mooney viscosity, e.g. 20–35, preferably 25 to 30 Mooney. It is preferably used in an amount up to 50, especially 15 to 30, parts by weight per hundred of the vinyl chloride polymer. An additive such as nitrile rubber can improve the physical properties of the composition. Polyvinyl acetate is preferably used in an amount up to 10 parts by weight per hundred of vinyl chloride polymer. It is useful as a processing aid.

The vinyl chloride polymer used preferably has a K value of 65–72. Polyvinyl acetate, where used, has a rather lower K value and, if desired, a similar amount of lower K value vinyl chloride polymer may be used to aid processing.

The vinyl chloride polymer composition may contain conventional compounding ingredients, e.g. plasticisers, lubricants and pigments, in amounts similar to those conventionally used for the soles of footwear. Typical plasticisers include the primary phthalate plasticisers conventionally used, e.g. dialphanol phthalate di iso octyl phthalate. (Primary plasticisers are those that can, if desired, be used as the only plasticiser in the composition).

The plasticisers may be used, for example, in an amount from 50 to 120 and preferably 60 to 70 parts by weight per 100 parts by weight of vinyl chloride polymer. These amounts of plasticiser are total amounts including both the primary plasticiser(s) and any secondary plasticisers in the composition. Secondary plasticisers are any liquids or low melting point solids used in the composition that have limited compatibility with pvc and a limited plasticising effect and therefore are not used as plasticisers in their own right.

The ionic antistatic agent may be, for example, a quaternary ammonium complex or an alkyl benzene sulphonate or triethanolamine alkyl sulphate. It should preferably not be used in an amount greater than 8 parts by weight per 100 parts by weight of vinyl chloride polymer and amounts from 2 to 6 parts by weight, e.g. 4 parts by weight, are preferred. Larger amounts of the ionic antistatic agent can cause undesirable reactions, exudations or staining.

The non-ionic antistatic agent may be used in larger amounts, e.g. up to 40, preferably 20 to 30, parts by weight per 100 of vinyl chloride polymer. The non-ionic antistatic agent is preferably diethylene glycol dicaprylate but other materials, e.g. poly glycol esters of low or medium molecular weight, may be used. The molecular weight limit will be governed by the compatibility of the material with pvc. Thus the non-ionic antistatic agents used will normally have a secondary plasticising effect.

Suitable non-metallic stabilisers include amino crotonates, e.g. thiodiethylene glycol bis-$\beta$ amino crotonate and mixtures of esters of amino crotonic acid with 1,4 butylene glycol and with C16-C18 fatty alcohols. These are preferably used in amounts from 3 to 10, preferably 6, parts by weight per hundred of vinyl chloride polymer.

Metallic stabilisers should preferably be excluded and, if used, should preferably be present in very small amounts.

Thus in a preferred embodiment the invention provides antistatic footwear having an outsole whose electrical resistance is from $5 \times 10^4$ to $5 \times 10^7$ ohms, the sole being formed from a vinyl chloride polymer composition containing an ionic antistatic agent, a non-ionic anti-static agent and a non-metallic stabiliser.

The upper of the footwear may be, for example, a textile fabric of natural, animal or synthetic fibres or of one or more of these materials and may be, if desired, faced with a material to which the vinyl chloride polymer composition will bond chemically or mechanically or to which it would weld under injection moulding conditions. Suitable facing materials, for example, may be of polyurethane or pvc.

If a textile lining or 'sock' is used in the footwear on the inside of the sole, it must be sufficiently openweave for the antistatic composition to strike through during formation of the sole. It will be appreciated that this is necessary to ensure that no insulating layer is formed between the antistatic outsole and the foot of the wearer. An insole may be incorporated if desired and this may be preferred for reasons of appearance and comfort. The insole may be conductive and may be made of a fully conductive rubber composition, for example a non-cellular natural rubber composition containing about 20 parts by weight of conductive carbon black per hundred parts of composition. Alternatively, an antistatic insole may be used to match the antistatic properties of the outsole.

Antistatic footwear according to the invention does not suffer variation in its level of electrical resistance following flexing in use. Although not wishing to be limited to any particular theory, it is believed that this is due to the ionic chain coupling occurring through the composition because of the ionic nature of the one antistatic agent (as opposed to the mechanical orientation of the carbon chains in carbon-black compounded antistatic formulations). Moreover, the thermoplastic compositions of the invention do not suffer from the variations in cure that can occur with rubber compositions.

Another important advantage of the invention is that by limiting the amount of ionic antistatic agent used and compounding with a non-ionic antistatic agent as well, it is possible to make plasticised pvc formulations that are sufficiently soft for footwear application without having problems of exudation and staining, while still meeting the overall required electrical specification. Thus it is possible to formulate coloured (as opposed to black) footwear compositions and more attractive footwear can be made. For example, it is now possible to make white, antistatic, pvc-soled shoes suitable for use in hospital operating theatres. It will be appreciated that in such theatres, safe antistatic-soled footwear is of considerable importance since any discharge of static electricity in the proximity of inflammable gases could be highly dangerous.

It is possible that part only of the outsole need be formed from the antistatic composition described in this specification but normally it will be found convenient and useful to form the whole outsole from the composition.

The compositions used in the invention may be mixed in a high-speed mixer to produce a dry, free-flowing powder or mixed to produce granules. In either case conventional, well-known techniques can be utilised.

Conventionally used secondary stabiliser plasticisers may also be included in the compositions. For example, epoxidised unsaturated vegetable oils, e.g. soya bean oil or tall oil or synthetic epoxidised reaction products of C4 to C12 alcohols with unsaturated fatty acids may be used. An example of the latter is iso-octyl epoxy stearate.

The invention is further illustrated by the following Example which describes the manufacture of antistatic shoes.

EXAMPLE

An antistatic pvc composition was made to the following formulation by blending in a high speed mixer.

| | Parts by Weight |
|---|---|
| Poly (vinyl chloride) resin (K value 70) | 100.0 |
| Di alphanol phthalate plasticiser | 65.0 |
| Di ethylene glycol dicaprylate (non-ionic antistatic agent) | 30.0 |
| Iso-octyl epoxy stearate (secondary plasticiser/stabiliser) | 20.0 |
| Quaternary ammonium complex (ionic antistatic agent) | 4.0 |
| Amino crotonate (non-metallic stabiliser) | 6.0 |
| Stearic Acid (lubricant) | 0.5 |
| White pigment | 5.0 |

The composition had a British Standard Softness of 125 according to BS 2782, method 307 (equivalent to about 43 Shore A Hardness).

Soles of the above formulation were formed by injection moulding the composition using conventional machinery onto canvass uppers. The uppers and soles were mechanically locked together.

A conductive insole of the following formulation was fitted in the shoe.

| | Parts by Weight |
|---|---|
| Natural Rubber | 30 |
| Stearic Acid | 0.5 |
| Zinc Oxide | 2.0 |
| Mineral Rubber | 2.0 |
| Whiting | 14.0 |
| Mineral Oil | 2.0 |
| Wood Resin | 0.5 |
| Tetramethyl thiuram disulphide | 0.23 |
| Zinc diethyl dithiocarbamate | 0.16 |
| 20 mesh tyre crumb | 23.0 |
| Conductive carbon black | 20.0 |
| Sulphur | 0.88 |

The white-soled shoes so obtained were tested according to BS 2050 and found to have a resistance of $1 \times 10^7$ ohms.

It will be appreciated that the outsole formulation may be varied as is well known in the art to produce a range of softness values within the desired range of 65 to 130 British Standard Softness (40 to 65 Shore A Hardness) the present invention.

Having now described out invention what we claim is:

1. Antistatic footwear at least the outsole of which is formed from a composition comprising a vinyl chloride polymer, a non-ionic antistatic agent, an ionic antistatic agent and a stabilizer for the vinyl chloride polymer, said ionic antistatic agent being present in an amount of from 2 to 8 parts by weight per hundred parts of said vinyl chloride polymer, said stabilizer consisting essentially of a nonmetallic stablizer being present in an amount of from 3 to 10 parts by weight per hundred parts of said vinyl chloride polymer, said vinyl chloride polymer being blended with a minor proportion of a material selected from the group consisting of nitrile rubber and polyvinyl acetate, and said outside having a Shore A hardness in the range 40 to 65 and an electrical resistance of from $5 \times 10^4$ to $5 \times 10^7$ ohms.

2. Antistatic footwear according to claim 1, in which nitrile rubber is used and is present in an amount from 15 to 30 parts by weight per 100 of the vinyl chloride polymer.

3. Antistatic footwear according to claim 1, in which polyvinyl acetate is used and is present in an amount up to 10 parts by weight per 100 of vinyl chloride polymer.

4. Antistatic footwear at least the outsole of which is formed from a composition comprising a vinyl chloride polymer, a non-ionic antistatic agent, an ionic antistatic agent and a stabilizer for the vinyl chloride polymer, said ionic antistatic agent being selected from the group consisting of alkyl benzene sulphonates, quaternary ammonium complexes and triethanolamine alkyl sulphate and being present in an amount of from 2 to 8 parts by weight per hundred parts of said vinyl chloride polymer, said stabilizer consisting essentially of a non-metallic stabilizer being present in an amount of from 3 to 10 parts by weight per hundred parts of said vinyl chloride polymer, and said outsole having a Shore A hardness in the range 40 to 65 and an electrical resistance of from $5 \times 10^4$ to $5 \times 10^7$ ohms.

5. Antistatic footwear according to claim 4, in which the composition contains from 50 to 120 parts by weight of plasticiser per 100 parts by weight of vinyl chloride polymer.

6. Antistatic footwear according to claim 1, in which the ionic antistatic agent is present in an amount of from 2 to 6 parts by weight per 100 parts of vinyl chloride polymer.

7. Antistatic footwear according to claim 4, in which the non-metallic stabiliser is an amino crotonate.

8. Antistatic footwear according to claim 7, in which the non-metallic stabiliser is selected from the group consisting of thiodiethylene glycol bis-62 amino crotonate and mixtures of esters of amino crotonic acid with 1,4 butylene glycol and with C16–C18 fatty alcohols.

9. Antistatic footwear according to claim 4, in which an open-weave textile liner is used on the inside of the outsole.

10. Antistatic footwear according to claim 4, which includes an insole of a fully-conductive rubber composition.

11. Antistatic footwear according to claim 10, in which said rubber composition is a non-cellular natural rubber composition containing about 20 parts by weight of conductive carbon black per 100 parts of composition.

12. Antistatic footwear according to claim 10, in which the insole is compounded to have antistatic properties comparable to those of said outsole.

13. Antistatic footwear at least the outsole of which is formed from a composition comprising a vinyl chloride polymer, a non-ionic antistatic agent, an ionic antistatic agent and a stabilizer for the vinyl chloride polymer, said ionic antistatic agent being present in an amount of from 2 to 8 parts by weight per hundred parts of said vinyl chloride polymer, said stabilizer consisting essentially of a non-metallic stabilizer being present in an amount of from 3 to 10 parts by weight per hundred parts of said vinyl chloride polymer, said non-ionic antistatic agent being selected from the group consisting of diethylene glycol dicaprylate and polyglycol esters of low or medium molecular weight, and said outsole having a Shore A hardness in the range 40 to 65 and an electrical resistance of from $5 \times 10^4$ to $5 \times 10^7$ ohms.

14. Antistatic footwear according to claim 13, in which the non-ionic antistatic agent is used in an amount of up to 40 parts by weight per 100 of vinyl chloride polymer.

15. Antistatic footwear according to claim 14, in which the non-ionic antistatic agent is used in an amount of from 20 to 30 parts by weight per 100 of vinyl chloride polymer.

16. Antistatic footwear according to claim 13, in which the non-metallic stabilizer is an amino crotonate.

17. Antistatic footwear at least the outsole of which is formed from a composition comprising a vinyl chloride polymer, a non-ionic antistatic agent, an ionic antistatic agent and a stabilizer for the vinyl chloride polymer, said ionic antistatic agent being selected from the group consisting of alkyl benzene sulphonates, quaternary ammonium complexes and triethanolamine alkyl sulphate and being present in an amount of from 2 to 8 parts by weight per hundred parts of said vinyl chloride polymer, said non-ionic antistatic agent being selected from the group consisting of diethylene glycol dicaprylate and polyglycol esters of low or medium molecular weight and being present in an amount of up to 40 parts by weight per hundred parts of said vinyl chloride polymer, said stabilizer consisting essentially of an amino crotonate non-metallic stabilizer and being present in an amount of from 3 to 10 parts by weight per hundred parts of said vinyl chloride polymer, said composition optionally including from 50 to 120 parts by weight of plasticizer per hundred parts of said vinyl chloride polymer, and said outsole having a Shore A hardness in the range 40 to 65 and an electrical resistance of from $5 \times 10^4$ to $5 \times 10^7$ ohms.

* * * * *

UNITED STATES PATENT OFFICE
CERTIFICATE OF CORRECTION

Patent No. 4,127,552 Dated November 28, 1978

Inventor(s) William Thomas BIDSTON et al

It is certified that error appears in the above-identified patent and that said Letters Patent are hereby corrected as shown below:

In claim 1, line 9, Column 5 "outside" should be --outsole--.

In Claim 8, line 49, Column 5 "bis-62" should be --bis-β".

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*